United States Patent [19]

Hartley et al.

[11] Patent Number: 4,781,357

[45] Date of Patent: Nov. 1, 1988

[54] TAP PLUG APPARATUS

[75] Inventors: Charles F. Hartley, Pittsburgh, Pa.; Wesley G. Page, Owensboro, Ky.

[73] Assignee: Aluminum Company of America, Pittsburgh, Pa.

[21] Appl. No.: 100,878

[22] Filed: Sep. 25, 1987

[51] Int. Cl.[4] ..... C21B 7/12

[52] U.S. Cl. ..... 266/45; 266/272

[58] Field of Search ..... 266/271, 272, 273, 45

[56] References Cited

U.S. PATENT DOCUMENTS

| | | | |
|---|---|---|---|
| 1,154,281 | 9/1915 | Bates | 266/272 |
| 1,661,745 | 3/1928 | Brosius | 266/272 |
| 1,841,202 | 1/1932 | O'Hare | 266/272 |
| 2,376,048 | 5/1945 | Giese, Jr. | 266/272 |
| 4,057,234 | 11/1977 | Brücher et al. | 266/272 |
| 4,553,743 | 11/1985 | LaBate, II et al. | 266/272 |

*Primary Examiner*—L. Dewayne Rutledge
*Assistant Examiner*—S. Kastler
*Attorney, Agent, or Firm*—Elroy Strickland

[57] ABSTRACT

Apparatus for safely plugging a furnace adapted to hold and transfer substantial amounts of molten material, the apparatus including a linkage assembly comprised of generally parallel bars pivotly connected together. A fluid operated cylinder is mechanically connected to the linkage assembly. An elongated bar is supported by the linkage assembly, and a plug is located at one end of the bar for disposal against and removal from a spout structure of a furnace. The cylinder translates the linkage assembly and thereby translates the bar and plug such that the plug can be moved to and from the spout structure. The plug is held against the spout structure under a positive force exerted by the cylinder.

5 Claims, 3 Drawing Sheets

TAP PLUG APPARATUS

BACKGROUND OF THE INVENTION

The present invention relates generally to tapping and plugging furnaces that hold and transfer molten material, such as molten metal, and particularly to an arrangement in which large plugs are positioned against and removed from large spout structures of furnaces in a precisely controlled manner.

Molten metal is transferred from a melting furnace to a holding furnace through refractory tap hole structures located in a sidewall of such furnaces at the hearth line, i.e., at the level of the floor of the furnace. The tapping of metal is ordinarily accomplished manually by handling a heavy steel bar, with a steel plug mounted on the end of the bar, which together can weigh 50 pounds or more. Large hammers are used to set the bar in the tap hole when plugging the furnace and to remove it when tapping metal. Such hammering can cause damage to the spout structure of the furnace. Spout structures are made of a refractory material, which material tends to be weak in tensile strength.

A major problem is the weight of the bar and plug assembly and the location of the spout assembly, i.e., plant personnel must hand munipulate the bar into place over a hot trough and often with molten metal moving at high velocity. Burn injuries can occur if proper procedures are not carefully followed.

Over the years, the size of holes for tapping molten metal has increased. Many are now four inches in diameter. The plug and bar assemblies have increased in weight accordingly. Safety considerations currently limit tap hole sizes to about four inches, but larger sizes are needed to decrease metal transfer time and increase production rates.

SUMMARY OF THE INVENTION

What is therefore needed for the process of transferring molten materials is a method to safely and reliably handle large tapping bars, for both single and dual tap spout assemblies and with precision, so that damage to refractory spout structures is avoided. In addition, adjustability, serviceability, easy removal of the plug and dependable plugging even under positive metal pressure conditions are important requirements.

These are effected in the present invention by a remotely operated simple machine such as fluid operated cylinder and linkage supporting a standard plug bar. The cylinder directs the bar through an arc to the most efficient plugging position and develops an appropriate amount of force in pounds to hold the plug against a tap hole to prevent leakage of molten material when the furnace contains molten material. To tap molten material, the operation of the cylinder is reversed, with approximately the same amount of force, to break the seal with the spout structure. The cylinder, in addition, retracts the bar through the same arc to a parallel position above the trough.

Preferably, a ceramic fiber cone is disposed over the nose of the plug before it is disposed against the spout structure. Such material is generally not reusable. The cone is contoured to fit the plug nose and effects a good seal against the spout structure. The cone, in addition, provides easy break-away action when the plug is withdrawn from the spout structure.

The plug is preferably a hollow body to reduce its weight.

BRIEF DESCRIPTION OF THE DRAWING

The invention, along with its objectives and advantages, will be best understood from consideration of the following detailed description and the accompanying drawing in which.

PREFERRED EMBODIMENTS

Figure 1:
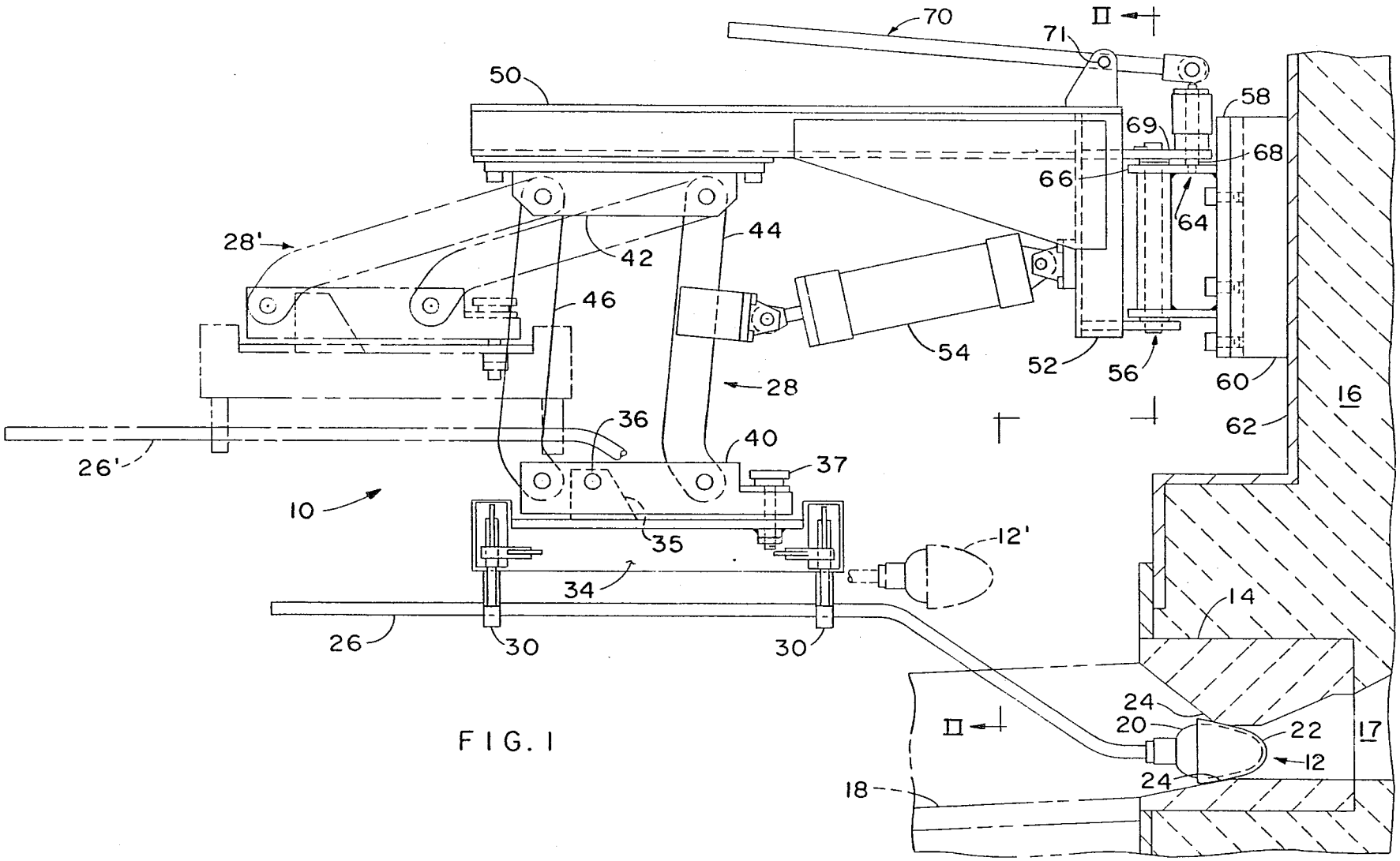
FIG. 1 is a side elevation view of the apparatus and assembly of the invention.

Referring now to the drawing, FIG. 1 thereof shows in side elevation (and partial phantom) an apparatus 10 for translating a plug means, generally designated by numeral 12, to and from a spout structure 14. Structure 14 is provided in the side wall 16 of a furnace (not otherwise shown) for receiving, holding, and releasing molten material (not shown), such as molten aluminum, through opening 17 in the spout, to a trough 18, shown only in partial dash outline in FIG. 1.

Plug means 12 includes, preferably, a hollow metal plug body 20, to reduce its weight, and a removable cover or cone 22 made of heat resistance material such as ceramic fibers. The material of the plug body is preferably cast iron. The cone is contoured to the shape of the nose of the plug body, and is disposed on the body by a workman while the plug is withdrawn from the spout and in a raised position, such as shown in phantom outline 12' in FIG. 1. Such ceramic materials are commercially available and generally not reuseable, as noted earlier.

The plug body and cone seat against an annular tapered surface 24 of the spout opening 17 in a manner that does not allow wedging of the plug in the opening, i.e., tapered surface 24 lies outside of the inner annular surface of the spout opening, and the nose of plug body 20 is relatively blunt such that it functions as a stopper than as a plug.

As seen in FIG. 1, plug body 20 is located at the end of an elongated rod 26 that is bent or formed in a manner that offsets the end of bar 26 supporting plug means 12 at a plane lower than the portion supported by a rectangular linkage assembly 28. This permits the linkage assembly, and associated structures and components described below, to be located in a position that is above and clear of spout structure 14 and trough 18.

Figure 2:
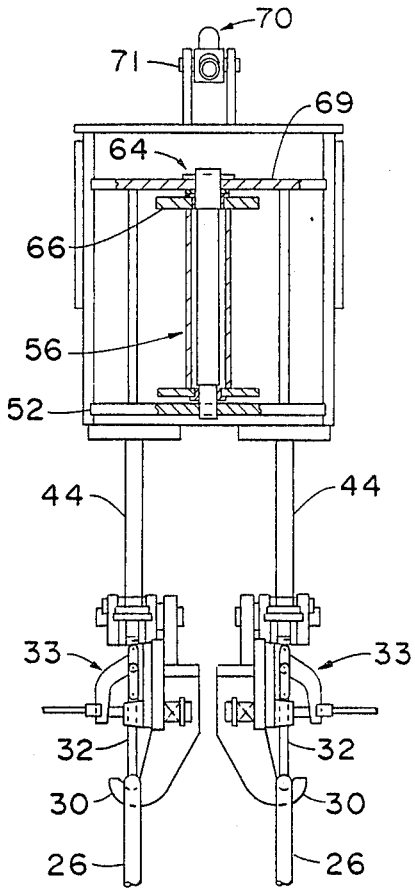
FIG. 2 is a front sectional elevation view of the assembly taken on line II—II of FIG. 1, FIG. 2 showing, in addition, a duplicate of the structure of FIG. 1 for plugging dual tap holes provided in the sidewalls of a furnace.

As shown in FIG. 2, two such elongated bars and plug means can be used to open and close dual spout structures (not shown) for greater productive effort in releasing molten material. In FIG. 2, each bar 26 is shown supported on a hook shaped structure 30 supported on a lower beam 34. Two such structures support each bar 26 at spaced apart locations along their upper lengths (see FIG. 1) in a generally horizontal plane. Each structure 30, in turn, is provided with a pin 32 that secures the bar in the seats of 30 by means 33 providing quick release clamping action. The quick release means are mounted on the lower beams 34, and are easily operated to release bars 26 for removal or for axial adjustment relative to linkage assemblies 28 and hence in precise relative position with respect to the seats of spout openings.

Figure 4:
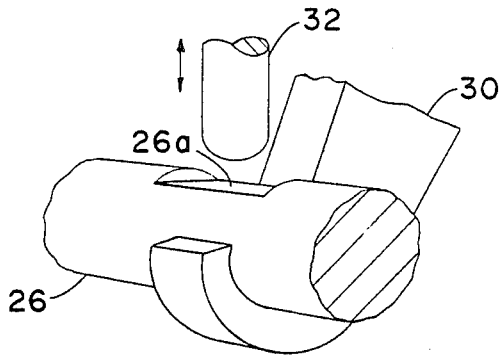
FIG. 4 is an enlarged perspective view of a portion of the bar and support shown in FIGS. 1 to 3.

FIG. 4 of the drawings shows the upper surface of bar 26 provided with a flat portion 26*a* for seating the lower end of pin 32. Such a portion prevents the bar from slipping relative to the pin. Two such flat portions are provided, one for each pin. The flat portions can be machined or otherwise formed in the bar.

Figure 3:
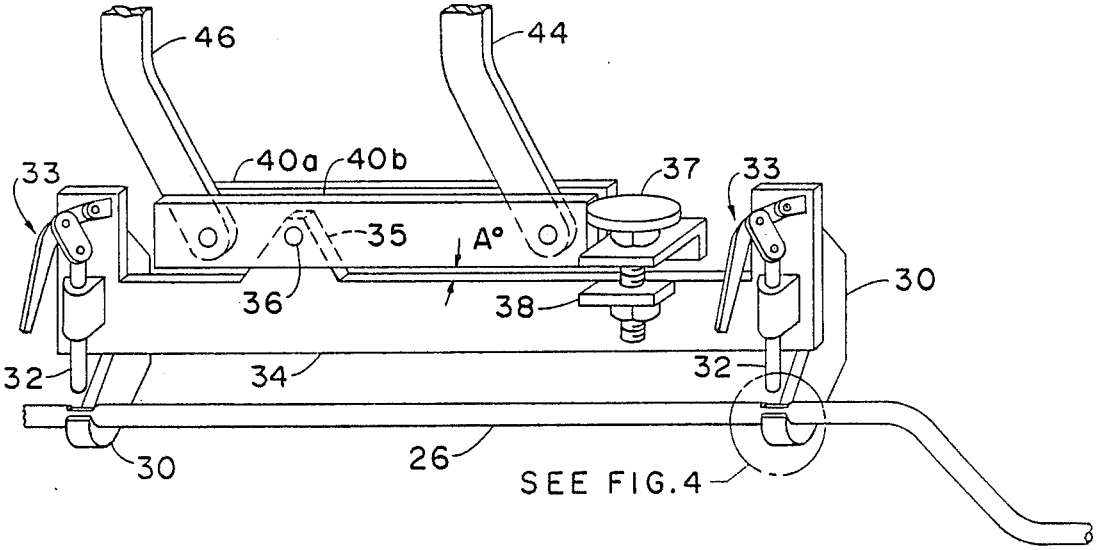
FIG. 3 is an enlarged view of a plug bar support and adjustment means shown in FIGS. 1 and 2.

Lower beam 34 is pivotally connected at 36 to (and in) a lower arm or bar 40 of linkage 28. Bar 40 is comprised of two parallel plates 40*a* and *b*, as seen in FIG. 3, spaced apart to receive an upper extension 35 of lower beam 34. A thumb screw 37, extending through the plates of bar 40 and into a lateral extension 38 (FIG. 3) of beam 34 sets and fixes the angle of the beam and thus that of bar 26. This permits proper "angling" of bar 26 relative to spout structure 14.

Lower bar 40 is one of four bars or arms (42, 44 and 46) that comprise assembly 28. The bars or arms are pivotally connected together adjacent their ends such that the assembly is collapsible, as shown in phantom at 28', and fully expandible, as shown in solid elevation in FIG. 1. The lower ends of vertical arms 44 and 46 extend into the space between plates 40*a* and *b*, as seen in FIG. 3. Similarly, upper bar 42 is preferably a double plate arrangement that receives the upper ends of arms 44 and 46.

Assembly 28 is supported on an overhead beam 50, the upper bar 42 of 28 being suitably attached to the underside of the beam. The beam, in addition, has an integral. vertically depending wall portion 52. Between this wall portion and the forward arm 44 of 28 is located at fluid operable cylinder 54, though other work performing devices may be used. One end of the cylinder is pivotally connected to forward arm 44, while the other end of the cylinder is pivotally connected to depending wall 52. Flexible fluid hoses (not shown) are suitably connected to the cylinder to run vertically up through beam 50 to avoid heat and mechanical damage to the hoses.

The system and structures thus far described are preferably swingable about a vertical axis in a horizontal plane so that plug (or plugs) 12 can be aligned with opening (or openings) 17 of spout structures 14 in a precision manner. This, again, assures repeated proper sealing (i.e. resealings) of opening 17 after each tapping operation in which molten material is removed from the furnace.

In FIG. 1, beam 50 is shown pivotally supported on furnace wall 16 by a vertical hinge arrangement 56. Plates 66 of hinge 56 are shown welded to a panel 58, which panel is bolted to a bracket 60. Bracket 60 is welded to steel shell 62 of the furnace. Other means, of course, can be employed to mount the apparatus of the invention. What is needed is the capacity to align with precision the plug means of the apparatus with spout opening(s) 17.

Figure 5:
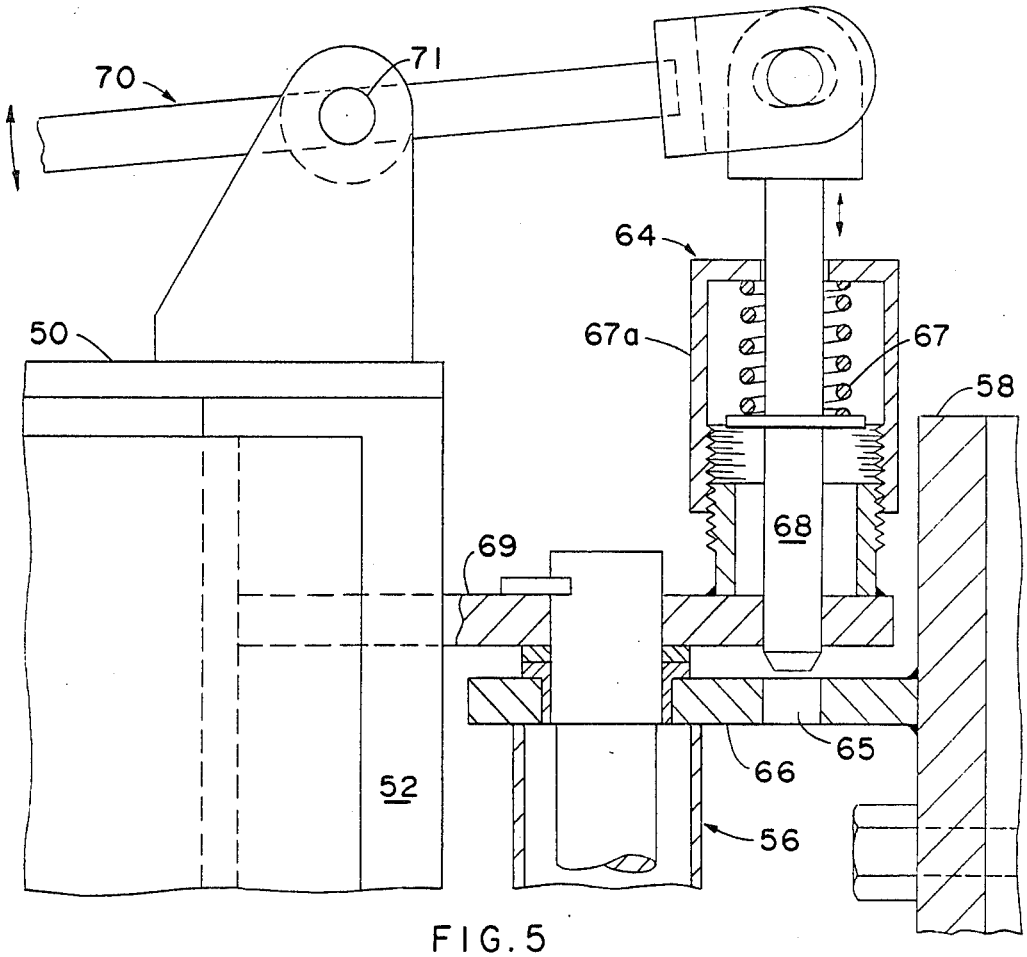
FIG. 5 is enlarged partial sectional view of means effective to fix the orientation of the plug and bar relative to the spout of a furnace.

The apparatus of the invention includes pin and indent means 64 that allows the assembly supporting the plug and bar to swing clear of the spout and trough. A horizontal array of say three indentations or openings 65 (only one which is visible in FIG. 5) and spaced apart preferably at 45° angles, are provided in an upper plate 66 of hinge 56. A vertical pin 68 is provided in a plate structure 69 located immediately above upper plate 66 and attached to beam 50. A center opening 65 in plate 66 is precisely located in relation to the axis of spout opening 17. Pin 68 seats in this opening to precisely locate and fix bar 26 and plug 12 on the axis of opening 17.

To swing the apparatus 10 out-of-the-way of the spout and trough, pin 68 is raised from the opening in plate 66 by a handle arrangement 70 pivoted at 71 on beam 50 and pivotally connected to the upper end of the pin. The handle of 70 raises the pin against the force of a large captive spring 67 allowing 50 and plate 69 to swing to a next position of the array of openings (65). The pin drops into the next opening (of the array) when the position of plate 69 and the pin are over the next opening. The spring maintains the pin in the opening until the spring is compressed against a retaining cap or container 67*a* by handle 70.

To seal the opening in spout 14, the apparatus 10 is centered on the opening as described above. Before the furnace receives a supply of molten material, a workman disposes cone 22 on plug body 20, and cylinder 54 is actuated by suitable valves (not shown), under control of a workman, that operate to smoothly translate bar 26 toward and position plug 12 in the spout in the manner shown in FIG. 1. Adjustment of the bar relative to its supports 30 on structure 34 are made and fixed via pins 32 before this operation so that the force of the plug and cone against surface 24 of spout opening 17 exerted by cylinder 54 will be sufficient to seal the opening when the cylinder translates the bar to the opening.

When it is desired to release the molten material in the furnace to trough 18, or plug the flow of molten material leaving the furnace, cylinder 54 is actuated to translate bar 26 in a smooth motion away from or towards the spout 14 and to the positions shown in solid elevation in FIG. 1 or in phantom in FIG. 1. The cylinder does this by moving the parallel bars of linkage 28 in a direction away from or towards the furnace, which movement collapses, or opens the rectangle of 28. The workman effecting control of cylinder 54 is at a location (such as an operator's console) remote from the flow of the molten material so that he is completely safe from being burned by the molten material. Yet, by the mechanics of system and apparatus of 10 he can precisely locate plug 12 in spout 14.

If, for any reason, the apparatus of 10 is inoperable, the bar can be released from hook structures 30, by quick release means 33, such that manual plugging and unplugging of the furnace can be accomplished until the apparatus is repaired.

While the invention has been described in terms of preferred embodiments, the claims appended hereto are intended to encompass all embodiments which fall within the spirit of the invention.

What is claimed is:

1. Apparatus suitable for safely plugging and unplugging a furnace adapted to hold and transfer molten material, comprising:

at least two linkage assemblies, with each assembly being comprised of bars pivotally connected together at locations adjacent their ends, a fluid operated cylinder mechanically connected to said linkage assemblies, an elongated bar supported by each linkage assembly, and plug means located at one end of each elongated bar for disposal against and removal from corresponding spout structures of the furnace by action of the cylinder translating through the linkage assembly, the linkage assembly being effective to move the elongated bars and plug means to and from the spout structures, and to hold the plug means against the spout structures under a positive force provided by the cylinder without the plug means becoming wedged in the spout structures.

2. The apparatus of claim 1 in which the plug means has a relatively blunt end and shape such that a seal is made at a location externally of inside surfaces of the spout structure.

3. The apparatus of claim 1 in which each elongated bar has a configuration that locates its plug end at a vertically lower position than a portion thereof supported by the linkage assembly.

4. The apparatus of claim 1 in which the assembly and cylinder are supported on hinge means, said hinge means being provided with pin and indent structures that permit the elongated bars and plug means to be rotated horizontally to an out-of-the-way position, or to a position centered on the axes of the spout structures.

5. A method of safely plugging and unplugging a furnace for holding molten material, comprising:

providing a linkage assembly and a fluid operated cylinder mechanically connected to the linkage assembly, using the linkage assembly to support an elongated bar, locating plug means at one end of the elongated bar for disposal against and removal from a spout structure of the holding furnace, and actuating the cylinder to effect movement of the linkage assembly and thus the elongated bar and plug means to and from the spout structure, and to hold the plug means against the spout structure under a positive force provided by the cylinder sufficient to seal the spout structure against the flow of molten material without the plug means becoming wedged in the spout structure.

* * * * *